US011666834B1

(12) United States Patent
Nguyen

(10) Patent No.: US 11,666,834 B1
(45) Date of Patent: Jun. 6, 2023

(54) INTERACTIVE TOY BRICK WITH A CAPACITIVE PROXIMITY SWITCH FOR TRIGGERING

(71) Applicant: Don Tiendung Nguyen, Lowell, MA (US)

(72) Inventor: Don Tiendung Nguyen, Lowell, MA (US)

( * ) Notice: Subject to any disclaimer, the term of this patent is extended or adjusted under 35 U.S.C. 154(b) by 0 days.

(21) Appl. No.: 18/048,638

(22) Filed: Oct. 21, 2022

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)

(58) Field of Classification Search
CPC ..... A63H 33/04; A63H 33/042; A63H 33/086
USPC ..... 446/85, 90, 91
See application file for complete search history.

(56) References Cited

U.S. PATENT DOCUMENTS 4,712,184 A * 12/1987 Haugerud ..... B25J 5/007 377/16
7,708,615 B2 * 5/2010 Munch ..... A63H 33/042 446/484
8,753,163 B2 * 6/2014 Gaute ..... A63H 33/042 446/85
8,753,164 B2 * 6/2014 Hansen ..... A63H 33/042 446/85
9,144,749 B2 * 9/2015 Munch ..... A63H 33/086
2019/0042530 A1 * 2/2019 Wang ..... H03M 1/66
2019/0094841 A1 * 3/2019 Denayer ..... G05B 19/41805
2019/0190193 A1 * 6/2019 Bdeir ..... H01R 13/6205
2020/0155925 A1 * 5/2020 Chen ..... A63H 33/22
2021/0197096 A1 * 7/2021 Donaldson ..... A63H 33/042
2022/0023767 A1 * 1/2022 Gaba ..... A63H 33/042
2022/0118375 A1 * 4/2022 Donaldson ..... A63H 29/22
2022/0143524 A1 * 5/2022 Donaldson ..... A63H 33/042
2022/0247218 A1 * 8/2022 Knights ..... A63H 33/042
2022/0339552 A1 * 10/2022 McAndrew ..... A63H 33/042
2022/0355218 A1 * 11/2022 Tezuka ..... A63H 33/042

* cited by examiner

*Primary Examiner* — Joseph B Baldori

(57) ABSTRACT

A functional toy brick adapted to perform a preconfigured function and is trigger responsive to the detection of close proximity of human limbs. The toy brick comprises a housing adapted for removable attachment to other commercially available toy bricks and has at least one translucent surface, an electronic element arranged inside the housing and adapted to perform a preconfigured function, a power source electrically connected to the electronic element for providing the power to perform the function, and a mechanical switch arranged inside the housing and operable from the outside to isolate the power source for prolonged storage. The electronic element further comprises a capacitive proximity switch for detecting close proximity of human limbs. The capacitive proximity switch comprises a sensor integrated circuit and at least one electrode, including one removable electrode which is remotely extended outside of the housing via an electrical wire and a pin receptacle.

3 Claims, 6 Drawing Sheets

INTERACTIVE TOY BRICK WITH A CAPACITIVE PROXIMITY SWITCH FOR TRIGGERING

FIELD OF THE INVENTION

The invention relates to a toy brick, particularly a self-contained functional toy brick incorporating a capacitive proximity switch for activation.

BACKGROUND OF THE INVENTION

Construction toy bricks have been one of the most popular toys for decades. There are many construction toy bricks commercially available. They are generally a collection of different-sized and -shaped toy bricks that can be releasably attached to each others to form a larger structure. Many functional toy bricks have been introduced to enhance the play value of the toys by adding features like generating light, producing sound, and controlling motors. They range from a self-contained brick that functions independently, a system of bricks that are physically connected together via wires and plugs, and a modular brick that has dependent elements coupled together to form a functional unit.

The existing self-contained functional toy bricks typically comprise an electronic element to perform a function, a power source such as coin batteries for providing power to perform the function, and a mechanical activation mechanism such as a switch or a push button. These toy bricks require manual activation from the users directly, such as pushing a button or turning a switch on and off, or indirectly via an adjacent brick that is pre-setup to make an impact when being moved. Manual activation limits the placement of the toy bricks as they can be hard to reach. An example of such toy bricks is presented in U.S. Pat. No. 8,517,789. While activation by the movement of the adjacent bricks requires thoughtful set up that is not easy to alter at the later time. An example is disclosed in U.S. Pat. No. 7,708,615.

A system of functional toy bricks comprises different bricks or devices connected together via a system of wires and plugs to share power and trade control signals. For example, a system consists of a power supply brick, a control brick, a remote controller, and several motor modules. Setting up these toy systems can be complicated and requires certain technical skills. An example is disclosed in U.S. Pat. No. 8,753,163.

A modular toy brick is a system of multiple dependent elements that are coupled together into a functional unit. A modular toy brick typically comprises an input element and an output element. The input element registers the commands and activates the output element to perform a preconfigured function. Different combinations of the input and output elements can yield a unit that provides a feature selected from a variety of choices. An example includes a push-button input element coupled with a light-generating output element. Another example includes a motion-sensor input element coupled with a sound-generator output element. Although modular toy bricks eliminate the needs of electrical wiring, these combined units are typically large and may require a certain abstract thinking to setup. An example can be found in U.S. Pat. No. 20200179818.

The existing functional toy bricks provide a wide range of features that have transformed simple construction toys into versatile and sophisticated toys enjoyed by all ages. These functional toy bricks range from rudimentary—manually activated light bricks—to highly advanced, controllable, and programmable systems. Today, a highly skilled tech-savvy user can build sophisticated and automated machineries from construction toy bricks. But yet the vast majority of players are younger children building simple structures.

It is therefore the purpose of the present invention is to provide a functional toy brick that is self-contained, compact, easy to use, and interactive by sensing close proximity of human finger; a functional toy brick that can simply be plugged and played to any built toy structures, thus instantly enhancing the play value of those old toy structures without rebuilding or modifying them.

SUMMARY OF THE INVENTION

The goal of the present invention is to provide a functional toy brick that is self-contained, compact, simple to use, and is interactively responsive to the detection of close proximity of human finger by incorporating a non-contact capacitive proximity switch. It should be emphasized that the term "close proximity" of human finger includes touching of human finger.

Capacitive proximity switch has been increasingly adopted in today electronic gadgets, household appliances, industrial and medical equipment to provide contact or non-contact switching. A capacitive proximity switch typically comprises a sensor integrated circuit (IC) connected to an electrically conductive surface, called electrode. The sensor establishes an electric field in the close proximity of the electrode's surface that creates a detection zone and monitors the capacitance at the electrode. When an object—referred to as a target—is reaching inside the detection zone, the target disturbs the electric field and causes the capacitance at the electrode to increase. The sensor detects the presence of the target when the capacitance exceeds a predefined "detection" threshold. Conversely, as the target moves away from the electrode, the capacitance decreases. The sensor detects the absence of the target when the capacitance drops below a predefined "release" threshold. A larger electrode's surface typically yields better detection although the sensitivity is heavily dependent on individual design. Technically, a capacitive proximity switch can detect the presence or absence of virtually any object regardless of material. However, it is more sensitive to those objects that are electrically conductive like metal objects or human limbs such as fingers. Herein, human finger is used as a representation of those objects although other human limbs or electrically conductive objects can also yield satisfactory result. Herein, the term close proximity refers to a distance range of 50 mm or less between the electrode surface and the human finger.

According to the preferred embodiment of the present invention, a functional toy brick includes a housing adapted for releasable attachment to other commercially available toy bricks and has at least one translucent surface, an electronic element arranged inside the housing that detects close proximity of human finger and performs a preconfigured function, a power source that supplies energy to the electronic element, and a mechanical switch arranged inside the housing and operable from the outside to isolate the power source for prolonged storage.

According to an aspect of the preferred embodiment of the present invention, the electronic element is adapted to perform a preconfigured function such as generating light and/or audible sound upon a trigger event detected by the capacitive proximity switch; the subsequent trigger event turns off the function.

According to another aspect of the preferred embodiment of the present invention, the electronic element further comprises a capacitive proximity switch which comprises a sensor integrated circuit connected to at least one electrically conductive surface, called electrode. The first electrode resides in the housing. The second electrode, referred to as the remote electrode, is extended outside of the housing and is removable. The remote electrode comprises an electrically conductive plate welded to one end of an electrical wire. The other end of the wire may include a connector pin, although the stripped end of the wire can also serve as its own connector pin. The electronic element further comprises a pin receptacle that is accessible from the outside to allow the connection of the remote electrode. Either the internal electrode or the remote electrode can be used to detect close proximity of the human finger without the other. The remote electrode is optional and provides a mean for having the sensing capability away from the functional toy brick, closer to an accessible location.

An advantage of the present invention is non-contact switching that allows the detection of the approaching human finger through a thin wall of the toy structures like a single layer of bricks.

Another advantage of the present invention is the remote electrode that allows the present functional toy brick to be mounted in hard-to-reach location while the remote electrode is extended to an accessible location. For instance, the present functional toy brick is mounted on the ceiling of a room structure, toward the backend, to provide a down light to the room interior while the remote electrode plate is extended to the front wall, under the window. The electrode plate is hidden from sight and will not alter the appearance of the structures from the front view. An approaching human finger near the window will trigger the toy brick to light up the room.

Another advantage of the present invention is that the compact and self-contained functional toy brick can be added to any toy building structures, including those structures that have been built without having to modify or rebuild them. The present functional toy brick can be attached to the ceiling of the room which typically unoccupied or the floor wherever space allows.

A major advantage of the present invention is that it instantly adds interactive features such as visual and audible effects to any toy building structures that otherwise would be static and dull. In order to illustrate one of possible uses of the present functional toy brick, herein referred to as "interactive brick", let's imagine a scenario where there is a typical house structure built out of compatible toy bricks. The house has a front door and many rooms with windows. The back of the house is typically left opened for accessing the interior of the rooms. Users can now simply attach an "interactive brick" to the ceiling of a room and place the connected remote electrode plate at the window of the room. Each room can have one or more "interactive bricks". To play, from the outside of the house, users simply point their finger near or touch the window which has the electrode plate placed on the inside; the room will light up with audible sound. Touching the window again will turn the light and sound off. Touching the front door will trigger the light in the foyer along with a sound of bell ring, dog barking, or "Who's there?" Touching the garage door will turn on the garage light along with car engine starting sound; likewise, conversation in the living room, loud snores in the bedroom. The possibilities are endless.

These and other objects, aspects and advantages of the present invention will be better appreciated in view of the drawings and following description of preferred and alternative embodiments.

Figure 1A:
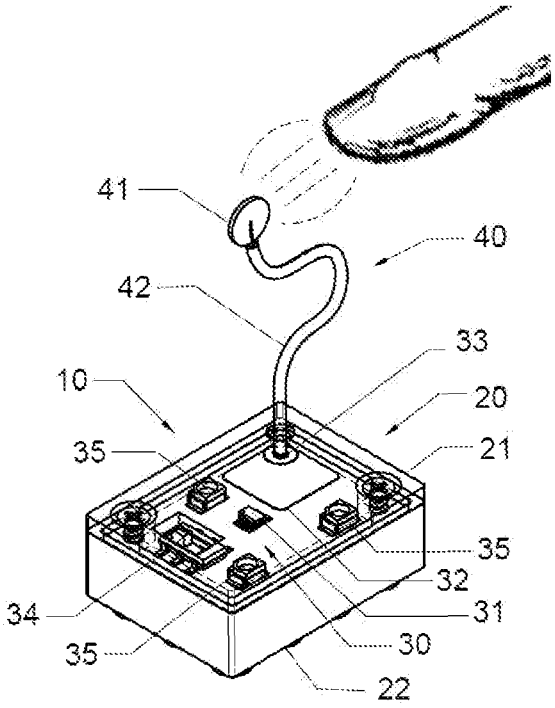
FIG. 1A is a perspective view of the present functional toy brick which is detecting close proximity of a human finger via its remote electrode.
Figure 1B:
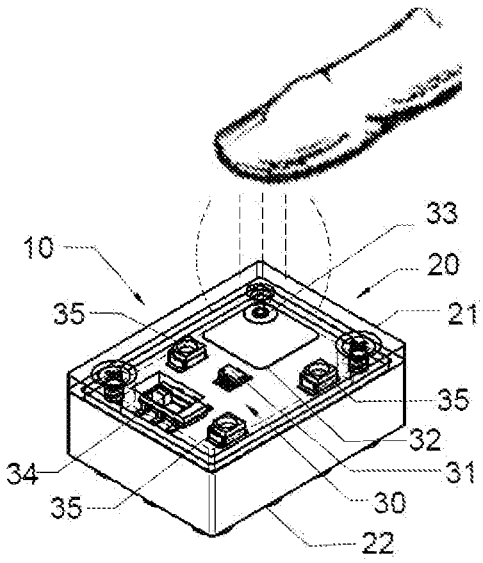
FIG. 1B is a perspective view of the same functional toy brick shown in FIG. 1A but without the remote electrode. The detection is done via the internal electrode.
Figure 1C:
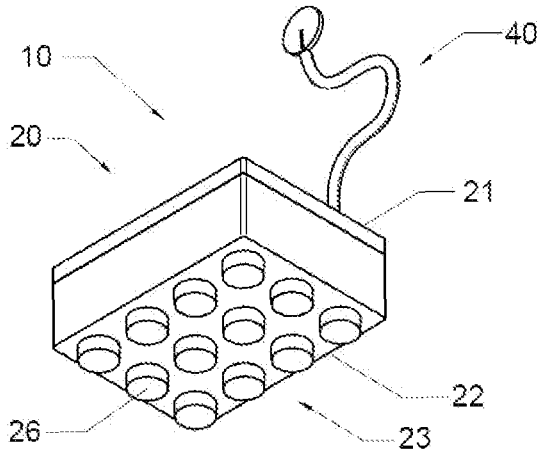
FIG. 1C is a perspective view of the functional toy brick shown in FIG. 1A at a different angle, showing the protruding attachment surface that has protruding studs.
Figure 1D:
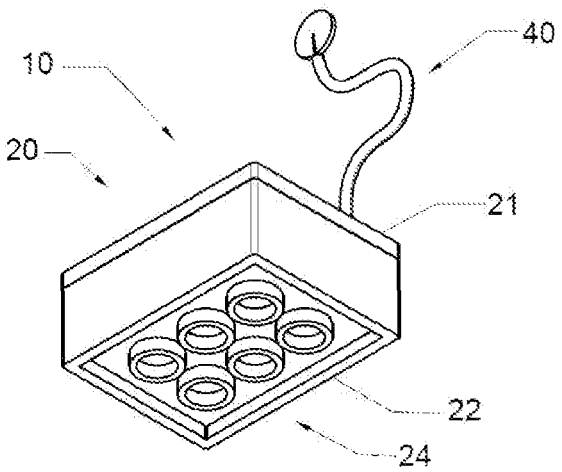
FIG. 1D is a perspective view of an alternative version of the functional toy brick shown in FIG.

1A at a different angle, showing the recessed attachment surface instead of the protruding one as shown in FIG. 1C.

Figure 1E:
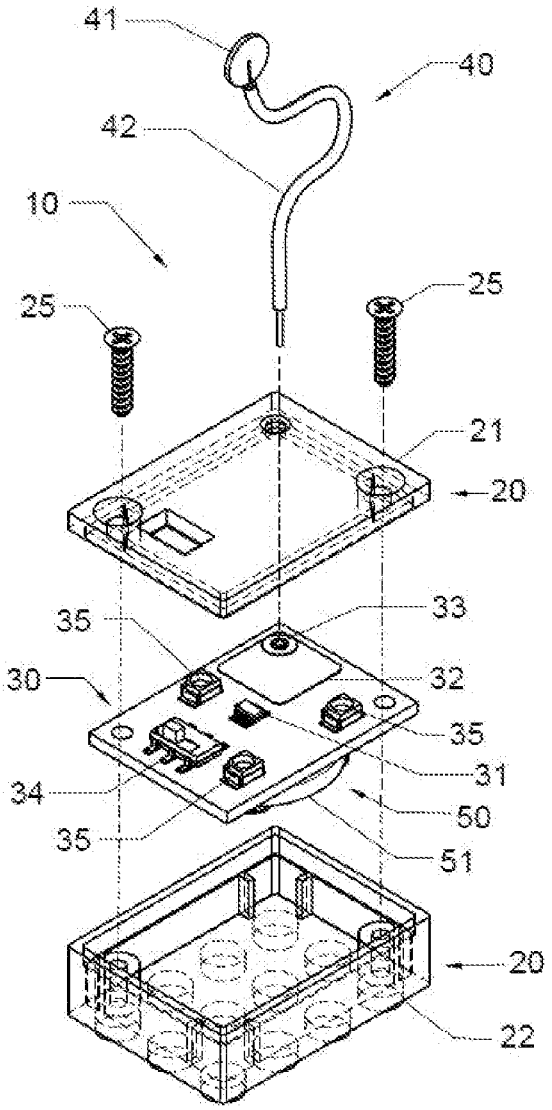

FIG. 1E is an exploded perspective view of the functional toy brick shown in FIG. 1A which is adapted for light-generating function only and has a coin battery as the power source.

Figure 2A:
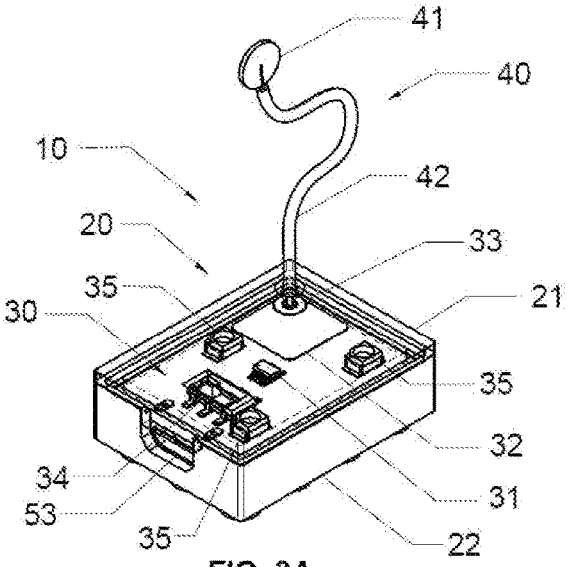

FIG. 2A is a perspective view of an alternative embodiment of the functional toy brick shown in FIG. 1A. This alternative embodiment has a rechargeable battery with a recharging connector instead of a coin battery for power source.

Figure 2B:
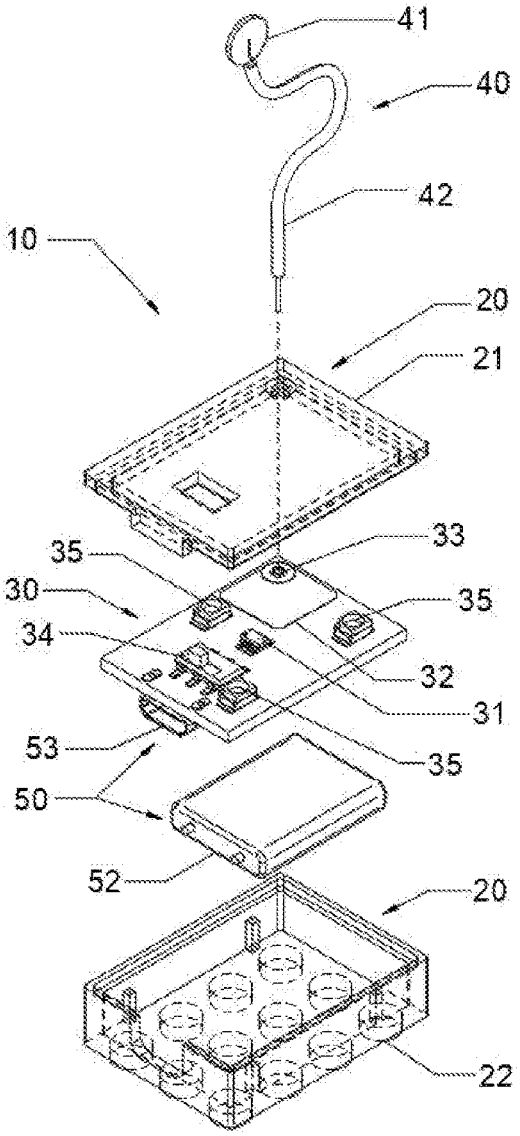

FIG. 2B is an exploded perspective view of the functional toy brick shown in FIG. 2A.

Figure 3A:
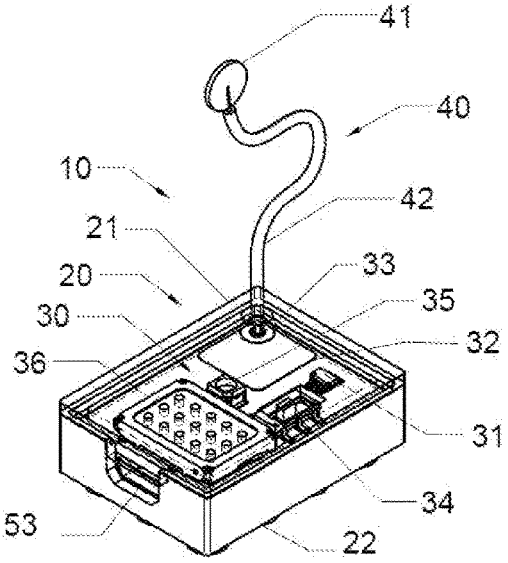

FIG. 3A is a perspective view of an alternative embodiment of the functional toy brick shown in FIG. 2A. This alternative embodiment has added speaker for sound function.

Figure 3B:
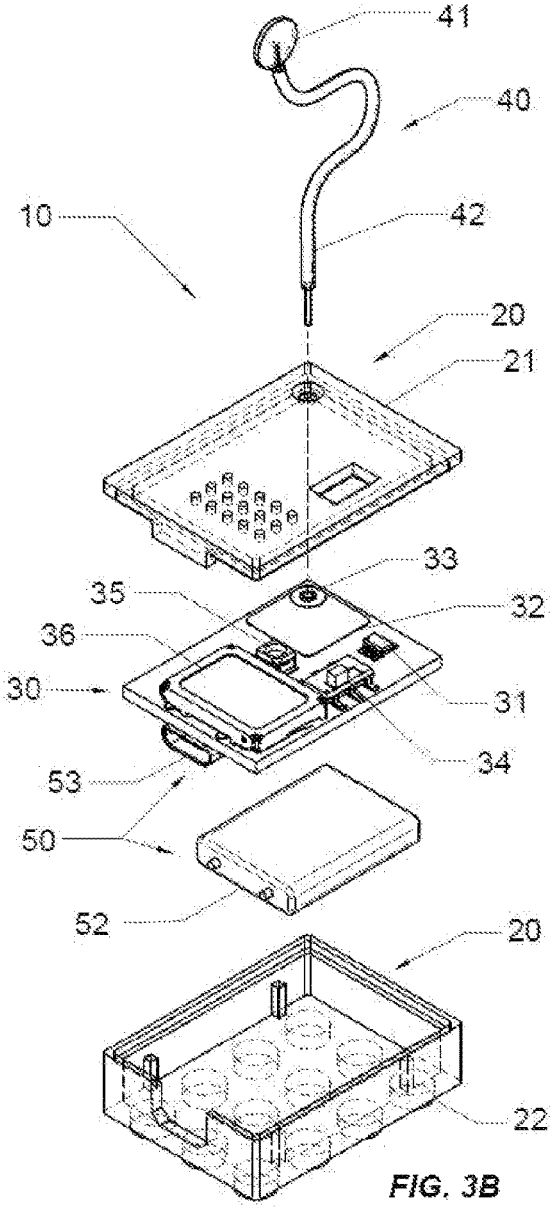

FIG. 3B is an exploded perspective view of the functional toy brick shown in FIG. 3A.

Figure 4A:
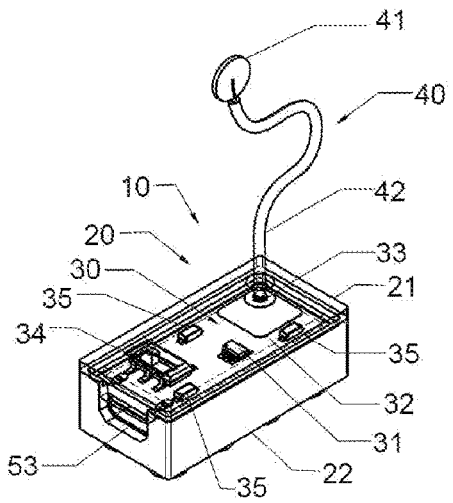

FIG. 4A is a perspective view of another alternative embodiment of the functional toy brick shown in FIG. 2A. This alternative embodiment has a smaller form, 2×4 stud configuration instead of 3×4 stud configuration.

Figure 4B:
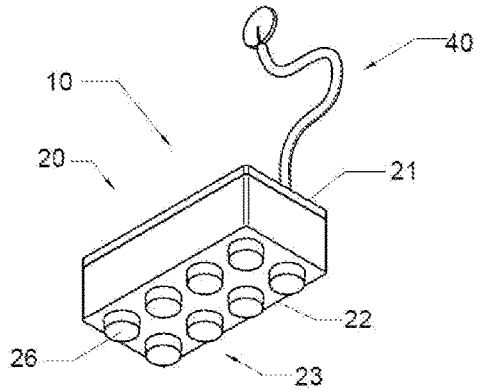

FIG. 4B is a perspective view of the functional toy brick shown in FIG. 4A at a different angle, showing the protruding attachment surface that has protruding studs.

Figure 4C:
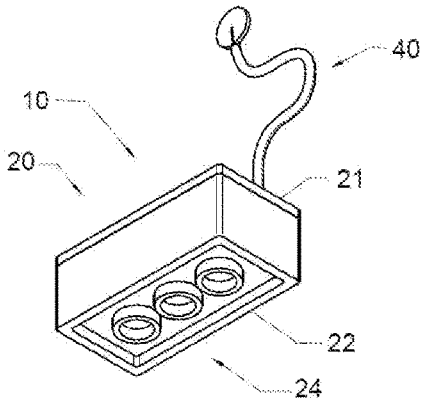

FIG. 4C is a perspective view of an alternative version of the functional toy brick shown in FIG. 4B which has the recessed attachment surface instead of the protruding one.

Figure 4D:
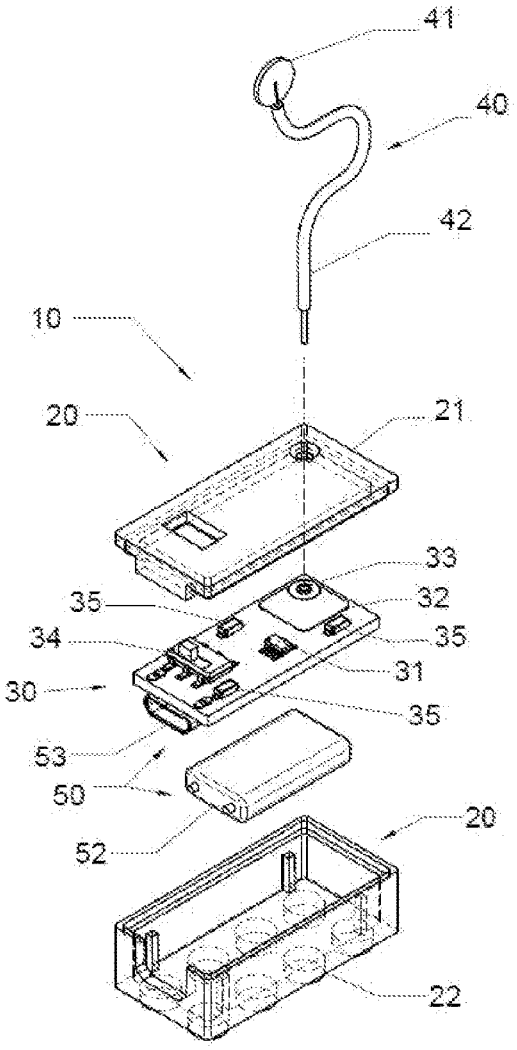

FIG. 4D is an exploded perspective view of the functional toy brick shown in FIG. 4A.

Figure 5:
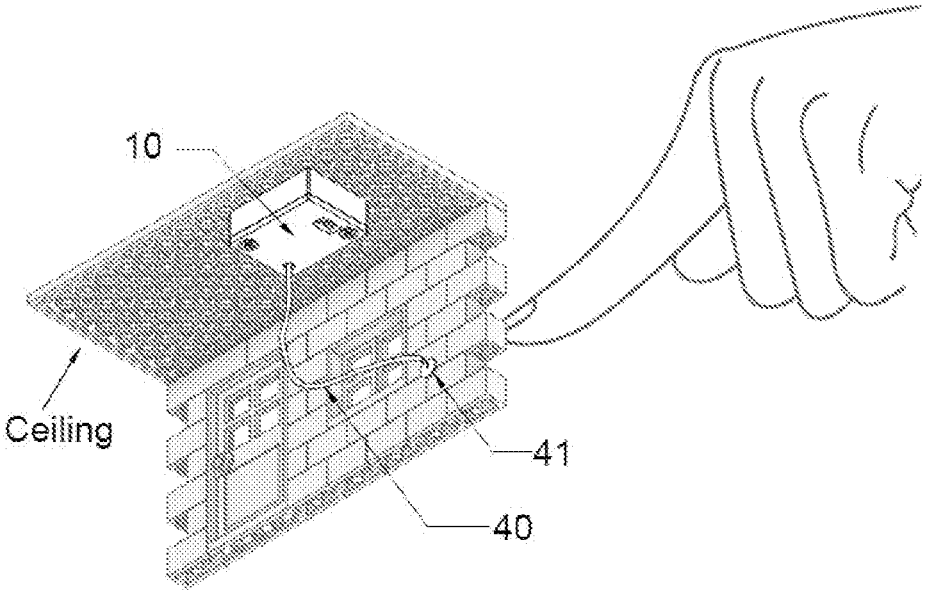

FIG. 5 illustrates the present functional toy brick mounted on the ceiling of a structure with the remote electrode placed behind the window. An approaching human finger outside the window, near the electrode, is detected by the sensor and activates the functional toy brick.

Figure 6:
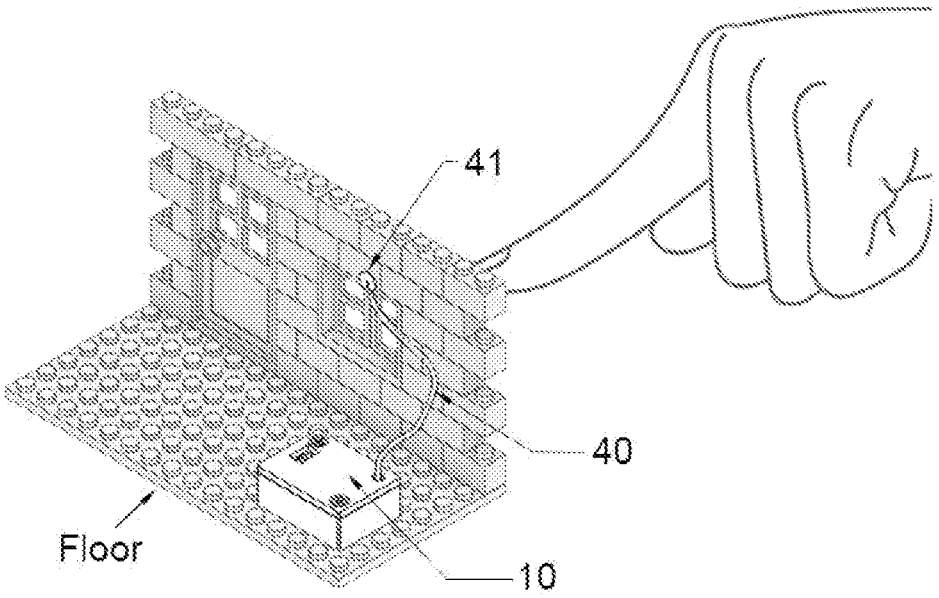

FIG. 6 shows similar illustration in FIG. 5 except that the present functional toy brick is mounted on the floor of the structure.

DETAILED DESCRIPTION OF THE INVENTION

Refer to FIG. 1A-1E, according to a preferred embodiment of the present invention, a toy brick 10 includes a housing 20, an electronic element 30, a remote electrode 40, a power source 50 (shown in FIG. 1E), and a mechanical switch 34.

The housing 20 is preferably made of plastic material and comprises an upper portion 21 and a lower portion 22. The upper portion 21 is translucent making the electronic element 30 visible from the inside of the housing. The lower portion 22 has an attachment surface configured for releasable engagement to other compatible toy bricks which typically have two complimentary attachment surfaces, the top surface with protruding studs and the bottom surface with cavities extending into the brick. In the preferred embodiment, the lower portion 22 has a protruding attachment surface 23 which has a plurality of studs 26 (see FIG. 1C). In an alternative embodiment, the lower portion 22 has a recessed attachment surface 24 which has cavities extending into the brick (see FIG. 1D). According to a preferred embodiment, the upper portion 21 and the lower portion 22 of the housing are coupled together with one or more screws 25 (see FIG. 1E). In an alternative embodiment, the upper portion 21 and the lower portion 22 of the housing are ultrasonically welded together.

In the preferred embodiment, the electronic element 30 is arranged inside the housing 20. The electronic element 30 is preferably a printed circuit board (PCB) with components mounted on it. The electronic element 30 comprises a circuitry to perform a preconfigured function and a capacitive proximity switch for activating the function. The electronic element 30 shown in FIG. 1A-1E is preconfigured to generate light when activated; therefore, it includes at least one light emitting diode (LED) 35. A capacitive proximity switch typically comprises a sensor integrated circuit (IC) 31 connected to an electrode 32, which is preferably an electrically conductive surface printed on the PCB. In the preferred embodiment, the capacitive proximity switch further comprises at least one remote electrode 40 which is extendable outside the housing and connected via a set of electrical wire and a pin receptacle. The remote electrode 40 comprises an electrically conductive electrode plate 41 welded to an electrical wire 42. The remote electrode 40 can be connected to the capacitive proximity switch via a pin receptacle 33 on the electronic element 30. The remote electrode 40 is optional because the capacitive proximity switch can sense and detect the close proximity of human finger using either the remote electrode plate 41 (see FIG. 1A) or the internal electrode 32 (see FIG. 1B).

In another aspect of the preferred embodiment, the power source 50 is arranged inside the housing 20 and provides the power to the electronic element 30. The power source can be at least one coin battery 51 (see FIG. 1E) or a combination of a rechargeable battery 52 and a connector 53 which is accessible from the outside of the housing 20 for recharging (see FIG. 2B). FIG. 1E shows a preferred embodiment where the power source is a coin battery 51 mounted on the back of the electronic element 30. When coin battery is selected for the power source, the housing's portions 21 and 22 are attached to each other with screws 25 so that the housing can be disassembled for replacing the coin battery. FIG. 2A and 2B show an alternative embodiment where the power source is a combination of a rechargeable battery 52 and a connector 53 accessible from the outside for recharging the battery. When rechargeable battery is selected for the power source, the housing 20 does not need to be disassembled because the rechargeable battery does not need to be replaced. In this case, the housing portions 21 and 22 can be welded together without the use of crews.

In another aspect of the preferred embodiment, a mechanical switch 34 is arranged inside the housing 20 and operable from the outside. The switch 34, connected between the power source 50 and the electronic element 30, is used to cut off the power source from the electronic element in order to preserve the power for prolonged storage.

FIG. 3A and 3B show another alternative embodiment wherein the electronic element 30 is preconfigured to generate both visible light and audible sound. In such case, the electronic element further comprises a speaker 36 along with at least one light emitting diode (LED) 35.

FIG. 4A to 4D show an example of another alternative embodiment which has similar function as those shown in FIG. 2A and 2B, but in a smaller form factor. FIG. 4B shows the toy brick 10 with the protruding attachment surface 23 that has a plurality of studs 26. FIG. 4C shows the toy brick 10 with the complementary recessed attachment surface 24 that has cavities extending into the brick. FIG. 4D is the exploded perspective view of the toy brick shown in FIG. 4A.

FIG. 5 illustrates a play example where the present functional toy brick 10 is attached upside down to the ceiling of a room structure with the remote electrode plate 41 placed behind the window. The toy brick has the protruding attachment surface 23 that is complementarily coupled with the recessed surface of the ceiling brick plate. The toy brick 10 can detect the approaching human finger on the outside of the window via the remote electrode plate 41 and perform a preconfigured function. An example is turning on the LEDs to provide down light to the room. A subsequent detection of an approaching human finger will deactivate the toy brick 10 and turn the light off.

FIG. 6 illustrates another play example similar to that of the FIG. 5, except that the present functional toy brick 10 is mounted on the floor of the room. The toy brick has the recessed attachment surface 24 that is complementarily coupled with the protruding surface of the floor.

It should be emphasized that the term "comprises/comprising" when used in this specification is taken to specify the presence of stated features, elements, or components but does not preclude the presence or addition of other features, elements, or components thereof.

While the invention has been described in its preferred and alternative embodiments and illustrated in the drawings, such description is to be considered as exemplary and not restrictive in character. It is understood that changes and modifications that come within the scope of the invention are desired to be protected. Accordingly, the scope of the invention should be determined not by the embodiments illustrated, but by the appended claims and their legal equivalents.

The invention claimed is:

1. A toy building brick comprising a housing adapted for removable attachment to other commercially available toy bricks and has at least one translucent surface, an electronic element arranged inside the housing and adapted to perform a preconfigured function, a power source electrically connected to said electronic element for providing power to perform said preconfigured function, and a mechanical switch arranged inside the housing and operable from the outside to isolate said power source for prolonged storage; wherein said electronic element further comprises a capacitive proximity switch that detects close proximity of electrically conductive objects including human limbs and said electronic element is trigger responsive by said capacitive proximity switch to activate said preconfigured function, wherein said capacitive proximity switch further comprises a sensor integrated circuit and at least one electrode; wherein the at least one electrode is extended outside said housing; wherein said extended electrode is mounted on an electrical wire that is plugged into a pin receptacle on said electronic element to allow the user to place said extended electrode at a desired location within a toy building brick assembly, said extended electrode is removable from said electronic element;

wherein said housing comprises an upper portion, which is translucent, and a lower portion having an attachment surface adapted for removable attachment to other commercially available toy bricks, and wherein said attachment surface is selected from a group comprising a protruding surface having a plurality of protruding studs configured for releasable attachment to a recessed surface of other compatible toy bricks, and a recessed surface configured for releasable attachment to a protruding surface of other compatible toy bricks.

2. The toy brick of claim 1, wherein said electronic element performs the preconfigured function selected from a group comprising generating light, generating sound, generating light and sound, generating electrical signal, and generating radio frequency signal.

3. The toy brick of claim 1, wherein said power source is selected from a group comprising at least one button battery, and a rechargeable battery connected to a connector arranged inside said housing and accessible from the outside for recharging said rechargeable battery.

* * * * *